US006331328B1

(12) United States Patent
Cheng

(10) Patent No.: US 6,331,328 B1
(45) Date of Patent: Dec. 18, 2001

(54) METHOD FOR APPLYING SILKSCREEN PATTERN TO COOKWARE

(75) Inventor: Stanley Kin-Sui Cheng, Kowloon (HK)

(73) Assignee: Meyer Mfg Co., Kowloon (HK)

( * ) Notice: Subject to any disclaimer, the term of this patent is extended or adjusted under 35 U.S.C. 154(b) by 0 days.

(21) Appl. No.: 09/226,850

(22) Filed: Jan. 7, 1999

(30) Foreign Application Priority Data

Jan. 9, 1998 (GB) ..... 9800514

(51) Int. Cl.[7] ..... B05D 1/32

(52) U.S. Cl. ..... 427/261; 427/264; 427/282; 427/287; 72/46

(58) Field of Search ..... 72/46; 427/261, 427/264, 287, 265, 270, 285, 282

(56) References Cited

U.S. PATENT DOCUMENTS 3,881,338 * 5/1975 Tischuk .
3,922,458 * 11/1975 Lynch .
4,204,021 * 5/1980 Becker .
4,347,722 * 9/1982 Ulam .
4,477,517 * 10/1984 Rummel .
4,537,800 * 8/1985 Kuziemka .
4,607,512 * 8/1986 Deville .
5,037,701 * 8/1991 Carre et al. .
5,987,727 * 11/1999 Shafik et al. .

* cited by examiner

*Primary Examiner*—Fred J. Parker
(74) *Attorney, Agent, or Firm*—Gray Cary Ware & Freidenrich

(57) ABSTRACT

A method is described for applying a continuous silkscreen pattern to cookware, which pattern extends from the base of the cookware, over a radius portion of the cookware to and into a side wall of the cookware. To achieve this a blank for forming a cookware product is first coated with a silicone polyester coating and baked at a first temperature. A desired pattern is then applied by a silkscreen process extending over not only the base portion of the blank but also that portion of the blank that will form the corner radius, and then the blank is baked for a second time at a higher temperature, before the blank is deformed and worked into the final cookware product.

10 Claims, 2 Drawing Sheets

METHOD FOR APPLYING SILKSCREEN PATTERN TO COOKWARE

FIELD OF THE INVENTION

This invention relates to a method for applying a desired pattern to a cookware product, and in particular to a method for applying such a pattern to the base of a cookware product by a silkscreen process. The invention also relates to a cookware product having a pattern applied in such a manner.

BACKGROUND OF THE INVENTION AND PRIOR ART

It is often desired to apply patterns to cookware products to increase their decorative appeal. Such patterns are often applied by using a silkscreen process. In particular decorative patterns may be applied to the base of a cookware product, eg a pan, to increase the aesthetic appeal of such a product. However, if a pattern is applied to the base only of an item such as a pan, then it can only be seen when the pan is not being used and cannot be seen when the pan is in use. Naturally this decreases the aesthetic benefit to the product given by the pattern.

It would therefore be desirable to be able to provide a pattern not only to the base of a cookware product, but also on to the sides of the product. Of course, this could easily be achieved by providing patterns to the base and side separately, but this is not desired since it results in a discontinuous pattern with a break between the two parts of the pattern which is not aesthetically pleasing. Previously there have been no cookware products provided with a continuous pattern that extends over the base of a cookware product and also around the corner radius of the product and along at least a part of the side of the product.

A cookware product such as a metal pan is generally formed as a blank that is then deformed into the desired pan shape. Attempting to provide a continuous pattern over the base and around the corner radius of the pan after formation of the pan shape is not practical on an industrial scale because the shape of the pan does not lend itself easily to silkscreen application on a large scale.

Generally when it is desired to apply a silkscreen pattern to the base of a product such as a pan, this is normally done before the blank is deformed. However, where this pattern is intended to extend beyond the base around the corner radius to the side wall of the pan, care needs to be taken when applying the silkscreen pattern to ensure that in the process of deforming the blank the silkscreen pattern in the region of the comer radius does not become cracked and disfigured by the act of deforming the blank.

SUMMARY OF THE INVENTION

According to the present invention there is provided a method- for applying a pattern to a cookware product comprising the steps of:

(a) applying a first coating to one side of a blank that is to form said cookware product, (b) baking said blank in a furnace at a first temperature, (c) applying a silkscreen paste over said first coating in a desired pattern extending over at least a portion of the blank that is to form the base of said product and over a corner radius portion of said blank, and (d) baking said blank in a furnace at a second temperature, said second temperature being higher than said first temperature.

Preferably both the first coating and the silkscreen paste comprise silicon polyester materials. The first coating may comprise a basecoat and a topcoat.

The actual temperatures of the baking of both the first coating of silicon polyester and the second coating of the patterned silkscreen layer will depend on the precise nature of the materials used, but in any event the baking of the patterned layer will be performed at a higher temperature than the baking of the first coating. The first coating should initially be baked at a lower temperature because it will be baked a second time when the patterned coating is applied and baked and two high temperature bakings would be detrimental to the first coating.

The pattern is applied to a blank for a cookware product, for example a cooking pan, prior to the product being formed by deformation of the blank in a conventional manner. Preferably also the side of the blank opposite from the applied pattern and which will form the interior of the cookware product, may be provided with a conventional surface coating, such as a non-stick coating, and this coating may be applied before or after the pattern is applied, though if the non-stick coating is a conventional PTFE coating it must be applied before the pattern since the high temperature required during the PTFE application process could otherwise damage the silkscreen pattern.

Preferably the pattern extends over the whole of the base area of the cookware product, as well as over the comer radius of the product, but alternatively the pattern may be applied to only a part of the base and to the comer radius and, optionally, a part of the side extending above the comer radius.

The invention also extends to a cookware product, and thus according to the invention there is also provided a cookware product when formed with a pattern by the method of the present invention described above.

According to the invention there is further provided a cookware product comprising a base portion, a side wall, and a comer radius portion forming a curved transition between said base portion and said side wall, said cookware product including a pattern applied to an exterior surface of said product by a silkscreen process, said pattern covering at least a part of said base portion and extending over said corner radius portion.

BRIEF DESCRIPTION OF THE DRAWINGS

An embodiment of the present invention will now be described by way of example and with reference to the accompanying drawings, in which.

DETAILED DESCRIPTION OF PREFERRED EMBODIMENTS

Figure 1:
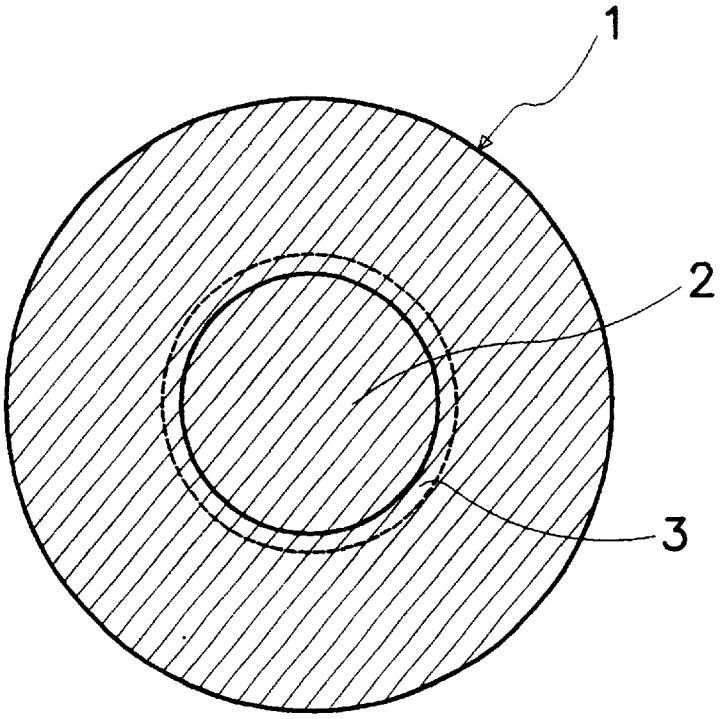
FIG. 1 is a view of a blank for forming a cookware product in the form of a cooking pan prior to deformation and showing a first coating applied thereto.

Referring firstly to FIG. 1 there is shown a blank 1 in the form of a circle that will eventually form a cookware product, for example a cooking pan, sauce pan, frying pan or the like. One side of this blank—the side not shown—will eventually form the interior surface of the cookware product and may therefore be provided with a conventional interior coating, for example a ceramic coating or a non-stick coating. Such an interior coating may be baked or otherwise heat-treated in any conventional manner.

The other side of the blank 1—the side shown in the Figures—is to form the exterior surface of the cookware product. To this surface is firstly applied a first coating of silicon polyester. This first coating may in turn comprise a basecoat and a topcoat. After application of the silicon polyester in a liquid form the blank is baked in a furnace for one minute. The baking temperature will depend on the precise nature of the silicon polyester coating but may typically be in the region of 200 degrees Centigrade. In FIG. 1 this first coating is illustrated by means of hatched lines extending across the blank.

Figure 2:
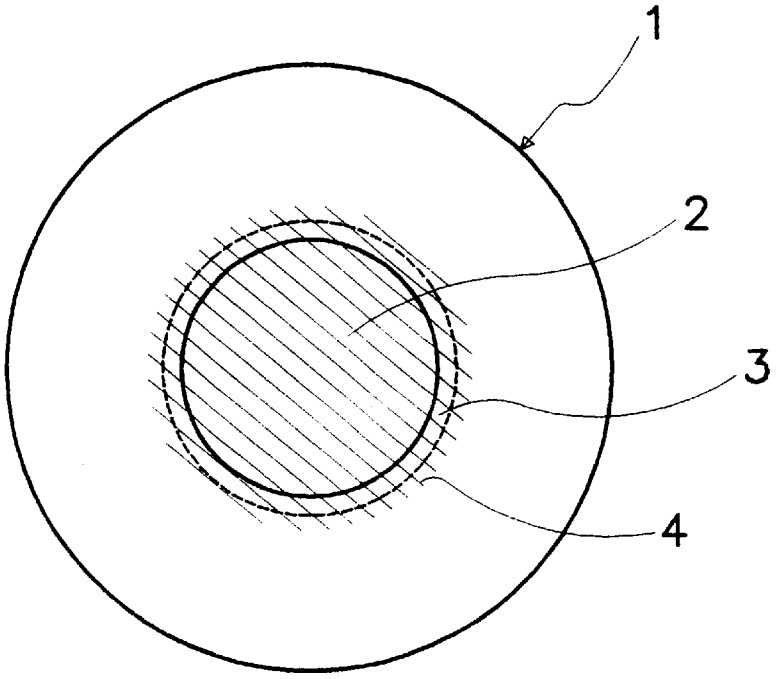
FIG. 2 is a view corresponding to FIG. 1 but showing the pattern applied thereto.

Following the application of a first silicon polyester coating a patterned coating is applied to the exterior to be surface of the blank. This pattern is applied by a silkscreen process using a silkscreen paste (which is also a silicon polyester material) applied through a silkscreen formed with the desired pattern. FIG. 2 shows hatched lines illustrating the area of the blank to which this silkscreen pattern is applied. The hatched lines representing the first coating in FIG. 1 are omitted from FIG. 2 for clarity.

The silkscreen pattern is applied to at least a part of the portion 2 of the blank which is to form the base of the cookware product after the blank has been subsequently deformed and worked into the final shape of the product. But it should be noted that the silkscreen pattern extends beyond this base portion 2 to the portion 3 of the blank 1 immediately surrounding the base portion 2 will form in use the corner radius of the cookware product. The pattern may also extend beyond portion 3 into the side wall portion 4.

In this context the term "corner radius" may be defined as the curved transition region between the base portion of the cookware product and the side walls of the cookware product. This transition may be a relatively sharp transition with a short radius portion of a small radius of curvature, or it may be a more gradual transition with a larger corner radius portion and a larger radius of curvature.

The applied silkscreen pattern may also be applied to portions of the blank 1 beyond the base portion 2 and the corner radius portion 3. In such a case the pattern will extend into at least a part of the side walls of the finished cookware product when it has been formed from the blank 1.

After application of the silkscreen paste in a desired pattern, the blank is once more baked in a furnace for one minute. Again the temperature will depend on the particular characteristics of the silkscreen paste used, but it will be at a higher temperature than was used for the baking of the first silicon polyester coating, for example the range of from 260 to 280 degrees Centigrade. The first coating is baked at a lower then normal temperature to begin with because it will be subjected to further baking when the silkscreen pattern is baked and two successive bakings at high temperature would be deleterious to the first coating.

A number of materials may be used for the first coating and for the silkscreen paste. For example, the first coating may comprise a basecoat of PIROSKAN BLACK™ 336CA2921 and a top coat of PIROSKAN IRC BLACK METALLIC™ 325CA3129 obtainable from Akzo Nobel Coatings SpA (using thinner 502CA3116 for PIROSKAN™ as necessary) with a first baking temperature of 240 degrees Centigrade for one minute. The silkscreen paste may comprise Copper 305CA3156 also available from Akzo Nobel Coatings SpA (using thinner 8.160.0084 for PIROSKAN™ as necessary). The second baking temperature would be 270 degrees Centigrade for one minute.

Alternatively, the first coating may comprise a high temperature resistance paint such as manufactured by Gandola & C.SpA, for example the first coating may comprise a basecoat of 69.9.011 PIETROSIL BLACK™, and a top coat of 69.0.018 PIETROSIL CLEAR METALLIC™ (using as a thinner 01.0.074 for PIETROSIL™ as necessary). The first baking temperature would be 270 degrees Centigrade for one minute. The silkscreen paste may comprise 69-L00331 PIETROSIL SILKSCREEN ENAMEL COPPER™ (using as a thinner 01.0.074 for PIETROSIL™ as necessary). The second baking temperature would be 300 degrees Centigrade for one minute.

Another possibility would be to use a deep draw resistance paint such as manufactured by Gandola & C.SpA, for example the first coating may comprise a basecoat of 63.9.010 PIETRESTER BLACK™, with a topcoat of 63.0.009 PIETRESTER CLEAR METALLIC™ (using as thinner 01.0.006 for PIETRESTER™ as necessary). The first baking temperature would be 200 degrees Centigrade for one minute. The silkscreen paste may comprise 63L-00330 PIETRESTER SILKSCREEN ENAMEL COPPER™ (using as thinner 01.0.006 for PIETRESTER™ as necessary). The second baking temperature would be 230 degrees Centigrade for one minute.

Figure 3:
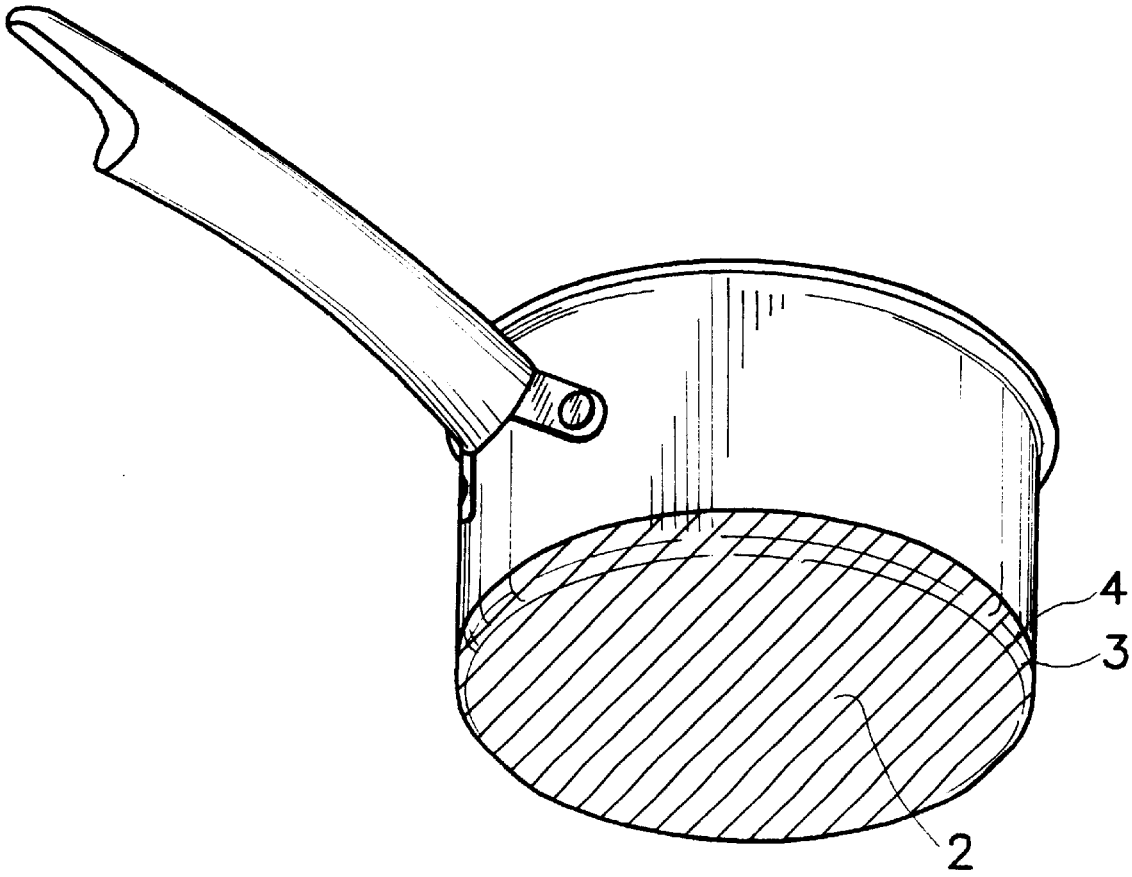
FIG. 3 is a perspective view of a finished cooking pan showing the pattern applied thereto.

Following baking of the silkscreen patterned layer, the blank may be deformed and worked into the final cookware product form in any conventional manner. As shown in FIG. 3 the resulting cookware product will have an exterior surface pattern on at least a part—and preferably all—of the base of the cookware product corresponding to the pattern applied to base portion 2 of blank 1. Since the pattern applied to the blank 1 extends over the portion 3 of the blank forming the comer radius, the finished pattern will also extend around the comer radius towards the side wall and, if the pattern applied to the blank extended beyond the comer radius portion 3, the pattern will also extend up at least a part 4 of the- side wall. Thus there is achieved a continuous pattern extending smoothly from the base of the cookware product, around the comer radius portion and into the side wall, thus enhancing the aesthetic effect of the cookware product. It should be note that the hatched lines in FIG. 3 are representative of the area of the pan to which the pattern is applied, and do not represent any particular desired pattern.

Furthermore the method of the present invention requires minimal changes to a conventional cookware product manufacturing production line, while at the same time overcoming the difficulties with prior techniques for applying a pattern to the base and corner radius of a cookware product.

What is claimed is:

1. A method for applying a pattern to a blank used to form a cookware product comprising the steps of:

a) applying a first coating of a silicon polyester material to one side of said blank;

b) baking said blank in a furnace at a first temperature;

c) applying a silkscreen paste of a silicon polyester material over said first coating in a desired pattern extending over at least a portion of said blank that is to form the base of said product and over a corner radius forming portion of said blank; and d) baking said blank in a furnace at a second temperature, said second temperature being higher than said first temperature.

2. The method of claim 1, wherein said second temperature is approximately 200 degrees Centigrade.

3. The method of claim 1, wherein said second temperature is in the range of 200 to 280 degrees Centigrade.

4. The method of claim 1, wherein said pattern is applied to a coated surface of said blank that will form an exterior surface of said product.

5. The method of claim 4, wherein an interior surface opposite the exterior surface of said blank is provided with a non-stick coating.

6. The method of claim 1, wherein said pattern extends over the whole of a base portion of said blank.

7. The method of claim 1, wherein said pattern extends across a comer radius forming portion of said blank into a side wall forming portion of said blank.

8. The method of claim 1, further comprising the step of deforming the blank into said cookware product without said pattern becoming cracked and disfigured.

9. A method of forming a cookware product having a pattern thereon, comprising the steps of:

a) providing a blank;

b) applying a first coating of a silicon polyester material to one side of the blank;

c) baking the blank in a furnace at a first temperature;

d) applying a silkscreen paste of a silicon polyester material over the first coating in a desired pattern extending over at least a portion of the blank that is to form the base of the product and over a corner radius forming portion of the blank;

e) baking the blank in a furnace at a second temperature, the second temperature being higher than the first temperature; and f) deforming the blank to form a cookware product having a base portion, a side wall and a corner radius therebetween over which the pattern extends.

10. A method of applying a pattern to a blank used to form a cookware product, comprising the steps of:

a) applying a first coating of a silicon polyester to one side of the blank;

b) baking the coated blank in a furance at a first temperature;

c) applying a silkscreen paste of a silicon polyester over the first coating in a desired pattern extending over at least a portion of the blank that is to form the base of the product and over a corner radius portion of the blank; and d) baking the silkscreen pasted blank in a furnace at a second temperature, the second temperature being higher than the first temperature.

* * * * *